US008995856B2

(12) United States Patent
Ikeda

(10) Patent No.: US 8,995,856 B2
(45) Date of Patent: Mar. 31, 2015

(54) IMAGE PROCESSING DEVICE, IMAGE PROCESSING METHOD AND PRINT SYSTEM

(71) Applicant: Konica Minolta, Inc., Tokyo (JP)

(72) Inventor: Makoto Ikeda, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 84 days.

(21) Appl. No.: 13/888,450

(22) Filed: May 7, 2013

(65) Prior Publication Data

US 2013/0343774 A1 Dec. 26, 2013

(30) Foreign Application Priority Data

Jun. 22, 2012 (JP) ..... 2012-141007

(51) Int. Cl.
*G03G 15/00* (2006.01)

(52) U.S. Cl.
CPC ..... *G03G 15/5033* (2013.01); *G03G 15/5062* (2013.01); *G03G 2215/0135* (2013.01); *G03G 2215/0164* (2013.01)
USPC ..... 399/49

(58) Field of Classification Search
CPC ..... G03G 15/5062; G03G 2215/00042; G03G 2215/00067
USPC ..... 399/46, 49, 72
See application file for complete search history.

(56) References Cited

U.S. PATENT DOCUMENTS

2012/0057885 A1* 3/2012 Paul et al. ..... 399/15

FOREIGN PATENT DOCUMENTS

| | | |
|---|---|---|
| JP | 2007-140402 | 6/2007 |
| JP | 2008-225377 | 9/2008 |
| JP | 2009-192896 A | 8/2009 |
| JP | 2010-66665 | 3/2010 |
| JP | 2010-220182 A | 9/2010 |
| JP | 2011-164602 | 8/2011 |

OTHER PUBLICATIONS

Japanese Office Action, Notice of Reason for Refusal, Patent Application No. JP 2012-141007. Mailing Date: Jul. 22, 2014 and English translation thereof (total pp. 12).

* cited by examiner

*Primary Examiner* — Gregory H Curran
(74) *Attorney, Agent, or Firm* — Lucas & Mercanti, LLP

(57) ABSTRACT

Disclosed is an image processing device including: a sample output unit to instruct a print device to successively print test images on a plurality of sheets of the recording paper; a profile preparing unit to prepare a plurality of profiles of the density unevenness in the sub-scanning direction in the plurality of sheets of the recording paper, from measuring data obtained by optically reading the test images; an analyzing unit to analyze the profiles by arranging the profiles in a printing order apart from each other so as to correspond to intervals of the sheets of the recording paper, and to detect a long period density unevenness in the sub-scanning direction, which has a long period extending through the plurality of sheets of the recording paper; and a correction data preparing unit to prepare correction data for removing the long period density unevenness.

16 Claims, 15 Drawing Sheets

IMAGE PROCESSING DEVICE, IMAGE PROCESSING METHOD AND PRINT SYSTEM

BACKGROUND OF THE INVENTION

1. Field of the Invention

The present invention relates to an image processing device, an image processing method and a print system for correcting density unevenness in the sub-scanning direction, which is caused in a print device.

2. Description of Related Art

In a print device for printing an image on recording paper, density unevenness is caused due to various types of factors. In order to reduce the density unevenness, the following correction process is generally carried out. In the correction process, a test image is printed on recording paper, and the density unevenness is measured by optically reading the printed image. Then, the correction data for cancelling the measured density unevenness is prepared, and the image data to be printed is corrected in accordance with the prepared correction data.

The density unevenness is caused in the main scanning direction which is perpendicular to the conveying direction of the recording paper and in the sub-scanning direction which is the conveying direction of the recording paper. Therefore, in order to precisely correct the density unevenness, it is desired to correct the density unevenness not only in the main scanning direction but also in the sub-scanning direction.

For example, in Japanese Patent Application Publication No. 2009-192896, as a method for reducing the density unevenness both in the main scanning direction and in the sub-scanning direction, the following technology is disclosed. In the technology, test charts having each constant density in the main scanning direction and in the sub-scanning direction are printed on a plurality of pages so as to gradually change the density of the test chart printed in every page, and the density unevenness of each density is measured in the main scanning direction and in the sub-scanning direction to correct the density unevenness.

On the other hand, because there are various types of factors of the density unevenness, it is effective to correct the density unevenness which is caused by a main factor. In Japanese Patent Application Publication No. 2010-220182, the following technology is disclosed. In the technology, from an output image or an image processed in an image forming process, such as an image formed on a photoconductive drum or an intermediate transfer belt, the density unevenness is resolved into the factors thereof and the factors of the density unevenness are extracted. Then, by sequentially correcting each of the extracted factors in series, the contribution ratio of each factor to the entire density unevenness is estimated.

The density unevenness in the sub-scanning direction is caused by, for example, the non-uniformity of rotating parts of the print device, such as a photoconductive drum, a intermediate transfer belt, various types of rollers and the like, and the switching on/off of a fixing heater. Further, the density unevenness in the sub-scanning direction is often periodically caused.

Conventionally, in case that the density unevenness in the sub-scanning direction is corrected, for example, as shown in FIG. 15, a test image 202 which is printed on one sheet of recording paper 201 and which has the even density is optically read to obtain the measuring data. In accordance with the obtained measuring data, the profile 203 of the density unevenness in the sub-scanning direction is prepared. Then, by carrying out the frequency analysis or the like for the profile 203, the periodic density unevenness in the sub-scanning direction is extracted and corrected.

However, in the density unevenness in the sub-scanning direction, there is density unevenness having a long period which cannot be contained in one sheet of recording paper 201. Therefore, in the conventional method using the measuring data obtained from the test image 202 printed on one sheet of recording paper 201, the above long period density unevenness in the sub-scanning direction cannot be removed.

As the factor of the long period density unevenness in the sub-scanning direction, for example, parts of the print device, which have the lengths longer than that of one sheet of recording paper, such as an intermediate transfer belt, the switching-on timing of a fixing heater, the toner supply timing and the like are considered.

In the technology disclosed in Japanese Patent Application Publication No. 2009-192896, a plurality of sheets of recording paper are used. However, the density unevenness for one density is measured by using only one sheet of recording paper. Further, in Japanese Patent Application Publication No. 2010-220182, the measuring data is obtained, by using one sheet of recording paper. These technologies are not suitable for the long period density unevenness in the sub-scanning direction.

SUMMARY

To achieve at least one of the abovementioned objects, an image processing device reflecting one aspect of the present invention comprises:

a sample output unit to instruct a predetermined print device for printing an image on conveyed recording paper, to successively print test images for detecting a density unevenness in a sub-scanning direction which is a conveying direction of the recording paper, on a plurality of sheets of the recording paper;

a profile preparing unit to prepare a plurality of profiles of the density unevenness in the sub-scanning direction in the plurality of sheets of the recording paper, from measuring data obtained by optically reading the test images which are successively printed on the plurality of sheets of the recording paper;

an analyzing unit to analyze the plurality of profiles in the plurality of sheets of the recording paper, which are prepared by the profile preparing unit, by arranging the profiles in a printing order apart from each other so as to correspond to intervals of the sheets of the recording paper, and to detect a long period density unevenness in the sub-scanning direction, which has a long period extending through the plurality of sheets of the recording paper; and a correction data preparing unit to prepare correction data for removing the long period density unevenness in the sub-scanning direction, which is detected by the analyzing unit.

Preferably, the analyzing unit prepares data in which the long period density unevenness in the sub-scanning density is removed from the profiles prepared by the profile preparing unit, and detects a short period density unevenness in the sub-scanning direction, which has a short period contained in one sheet of the recording paper, by analyzing the prepared data, and the correction data preparing unit prepares correction data for removing the detected short period density unevenness in the sub-scanning direction.

Preferably, the analyzing unit calculates an in-page density distribution which is always caused on a same position in the sub-scanning direction in one sheet of the recording paper, from the plurality of profiles in the plurality of sheets of the recording paper, which are prepared by the profile preparing unit, and detects the long period density unevenness in the sub-scanning density after the in-page density distribution is removed.

Preferably, the analyzing unit calculates the intervals of the sheets from the number of sheets on which the test image is printed by the print device in unit time, a convey speed of the recording paper and a length of the recording paper in the sub-scanning direction.

Preferably, the sample output unit instructs the print device to print predetermined marks on the plurality of sheets of the recording paper on which the test images are printed, so as to arrange the marks in the sub-scanning direction at regular intervals including the intervals of the sheets, and the analyzing unit calculates the intervals of the sheets in accordance with positions of the marks printed on the plurality of sheets of the recording paper.

Preferably, a sampling pattern of the measuring data for preparing the profiles of the density unevenness in the sub-scanning direction is changed according to a type of the density unevenness in the sub-scanning direction to be detected.

Preferably, the sample output unit instructs the print device to print the test images on the recording paper out of an effective image area.

Preferably, the image processing device further comprises a factor specifying unit to specify a factor of the density unevenness in the sub-scanning direction in accordance with a period of the detected density unevenness in the sub-scanning direction.

BRIEF DESCRIPTION OF THE DRAWINGS

The present invention will become more fully understood from the detailed description given hereinafter and the accompanying drawings given by way of illustration only, and thus are not intended as a definition of the limits of the present invention, and wherein:

FIGS. 6A to 6C are views showing the situation in which the profiles for ten test charts which are successively printed are arranged in the printing order in view of the intervals of the sheets of recording paper, and the like;

DETAILED DESCRIPTION OF PREFERRED EMBODIMENT

Hereinafter, a preferred embodiment of the present invention will be explained with reference to the accompanying drawings.

Figure 1:
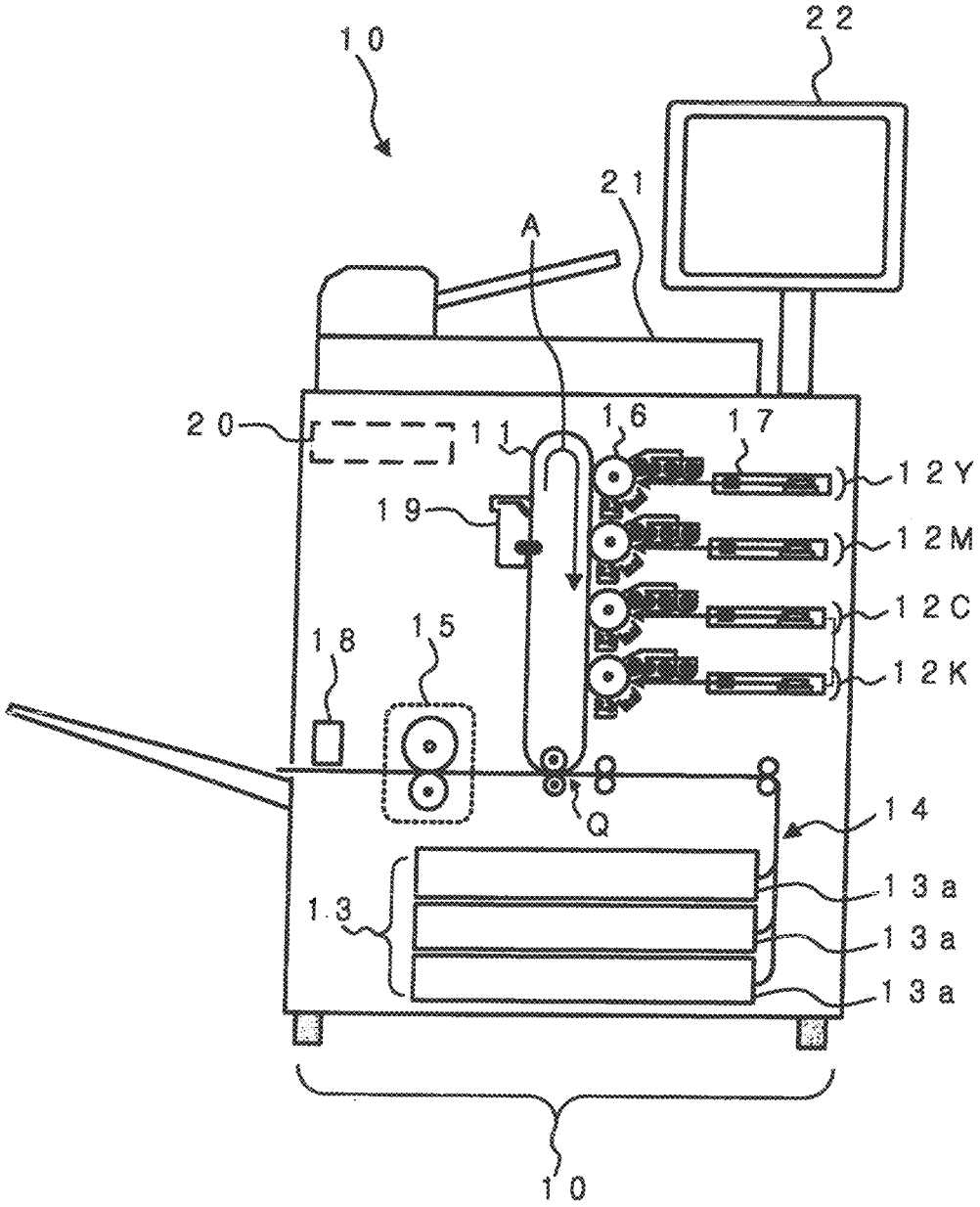
FIG. 1 is a view showing the mechanical schematic structure of the print system including the function of the image processing device according to the embodiment.

FIG. 1 is a view showing the mechanical schematic structure of the print system 10 including the function of the image processing device according to the embodiment. The print system 10 has a print function for printing out an image on recording paper in accordance with print data input from an external device via a network or the like, a copy function for printing out an image on recording paper in accordance with image data obtained by optically reading an original, and the like. The print system 10 is not required to carry out color printing, and may be a system for carrying out monochrome printing.

The print system 10 comprises an intermediate transfer belt 11 having a predetermined width, which is circularly bridged endlessly, four image forming units 12Y, 12M, 12C and 12K for forming single color toner images having the colors of yellow (Y), magenta (M), cyan (C) and black (K) respectively, on the intermediate transfer belt 11, a paper feeding unit 13 for feeding the recording paper, a conveying unit for conveying the fed recording paper, a fixing device 15, a belt cleaning device 19, a reading unit 18 for optically reading an image printed on the recording paper, and the like.

In the image forming units 12Y, 12M, 12C and 12K, the colors of the toners to be used are different from each other. These image forming units have the same structure. Each of the image forming units 12Y, 12M, 12C and 12K comprises a cylindrical photoconductive drum 16 as an electrostatic latent image carrier on which an electronic latent image is formed. Around the cylindrical photoconductive drum 16, a charging device, a developing device, a transfer device, a cleaning device and the like are provided. In each of the image forming units 12Y, 12M, 12C and 12K, a laser unit 17 having a laser diode, a polygon mirror, various types of lenses, mirrors and the like, is provided.

In each of the image forming units 12Y, 12M, 12C and 12K, the photoconductive drum 16 is rotated in a constant direction by a driving unit which is not shown in the drawing. The charging device uniformly charges the photoconductive drum 16. The laser unit 17 forms an electronic latent image on the surface of the photoconductive drum 16 by scanning the photoconductive dram 16 with the laser light which is switched on/off in accordance with the image data of the corresponding color.

The laser light repeatedly scans the photoconductive drum 16 in the axial direction thereof. By rotating the photoconductive drum 16, the two-dimensional electronic latent image is formed on the photoconductive drum 16. The direction (axial direction of the photoconductive drum) in which the laser light scans the surface of the photoconductive drum 16 is the main scanning direction. The direction in which the photoconductive drum 16 is rotated is the sub-scanning direction.

The developing device visualizes the electrostatic latent image on the photoconductive drum 16 by using the toner. The toner image formed on the surface of the photoconductive drum 16 is transferred to the intermediate transfer belt 11 at the portion where the photoconductive drum 16 contacts with the intermediate transfer belt 11. The cleaning device removes and collects the toner which remains on the surface of the photoconductive drum 16 by rubbing the remaining toner with a blade or the like after the transfer of the toner image.

The intermediate transfer belt 11 is wound so as to be bridged by a plurality of rollers, and is rotated in the direction of the arrow A in the drawing. In a process of the rotation of the intermediate transfer belt 11, the images (toner images) of the respective colors are formed on the intermediate transfer belt 11 so as to overlap the images in the order of the color Y, the color M, the color C and the color K by the image forming units 12Y, 12M, 12C and 12K. Thereby, the color image is composed. This color image is transferred from the intermediate transfer belt 11 to the recording paper at a second transferring position Q. The toner which remains on the intermediate transfer belt 11 after the transfer is removed by the belt cleaning device 19 provided on the downstream side of the second transferring position Q.

On the intermediate transfer belt 11, the width direction of the intermediate transfer belt 11 is the main scanning direction. The rotating direction of the intermediate transfer belt 11 is the sub-scanning direction. On the recording paper, the conveying direction of the recording paper is the sub-scanning direction. The direction (the width direction of the recording paper) perpendicular to the conveying direction is the main scanning direction.

The paper feeding unit 13 comprises a plurality of paper feed trays 13*a* that contain the recording paper used in printing. The paper feeding unit 13 feeds the recording paper sheet by sheet from the selected paper feed tray 13*a* toward the conveying unit 14. The conveying unit 14 has a function of conveying the recording paper fed from the paper feed tray 13*a* so as to pass the recording paper through the second transferring position Q and the fixing device 15, and discharging the recording paper to a discharge tray through a reading position of the reading unit 18. The conveying unit 14 is configured by conveying rollers and a guide unit that form a conveying passage, and by a motor that drives the conveying rollers.

The print system 10 further comprises a control board 20 for controlling the operations of the print system 10 and a scanner unit 21 for reading the original set by a user, an operation panel unit 22 for receiving the operation from the user and for displaying various types of windows, and the like.

Figure 2:
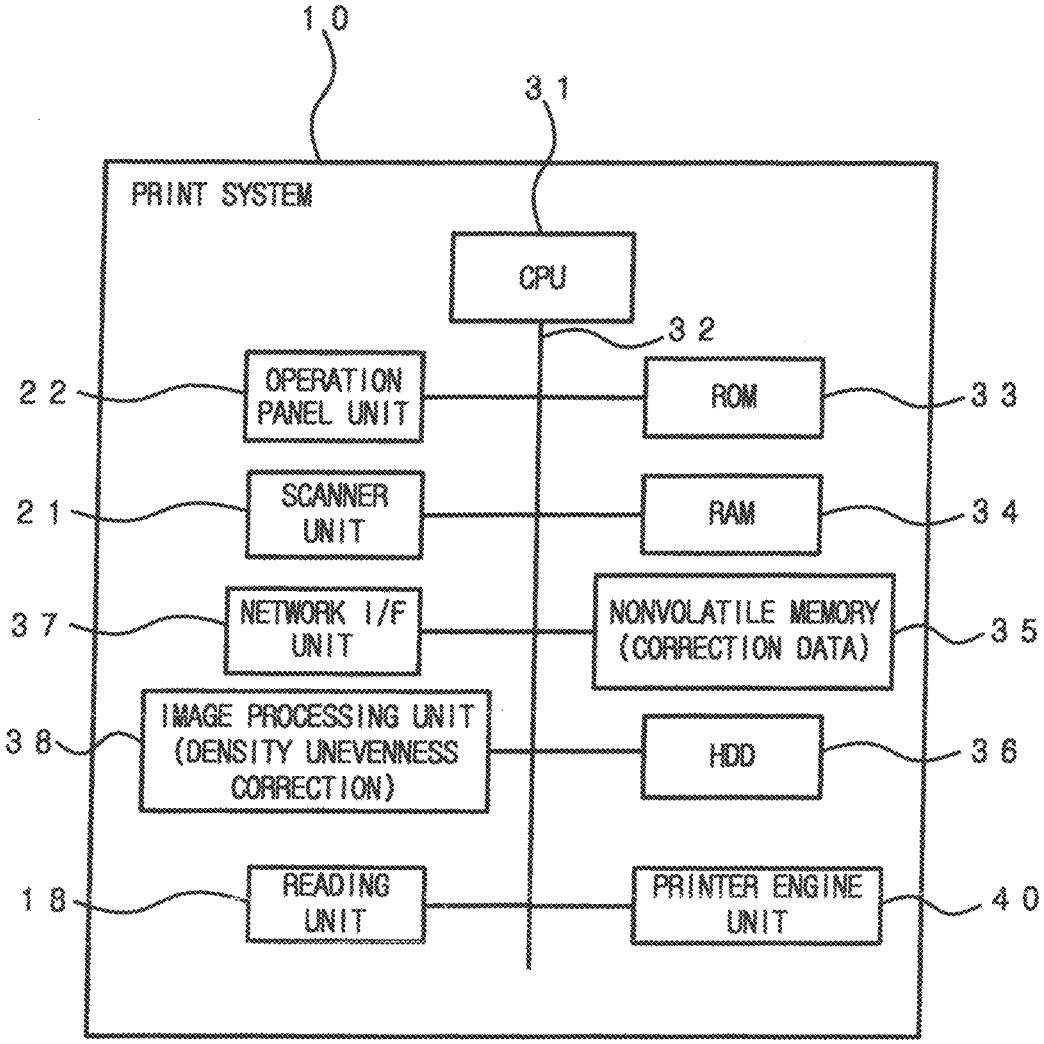
FIG. 2 is a block diagram showing the electric schematic structure of the print system according to the embodiment.

FIG. 2 is a block diagram showing the electric schematic structure of the print system 10. The print system 10 comprises a CPU (Central Processing Unit) 31 for controlling the whole operation of the print system 10. The CPU 31 is connected with a ROM (Read On Memory) 33, a RAM (Random Access Memory) 34, a nonvolatile memory 35, an HDD (hard disk drive) 36, the operation panel unit 22, the scanner unit 21, a network I/F (interface) unit 37, an image processing unit 38, the reading unit 18, a printer engine unit 40, and the like via a bus 32. The CPU 31, the ROM 33, the RAM 34, the nonvolatile memory 35, the image processing unit 38 and the like are mounted on the control board 20.

By the CPU 31, a middleware, application programs and the like are executed on an OS (Operating System) program as a base. In the ROM 33, various types of programs are stored. By executing the processes by the CPU 31 in accordance with these programs, various types of functions of the print system 10 are realized in addition to the operation relating to the correction of the density unevenness in the sub-scanning direction.

The RAM 34 is used as a work memory that temporarily stores various types of data when the CPU 31 executes the programs, an image memory that stores image data, and the like.

The nonvolatile memory 35 is a rewritable memory (flash memory) in which the contents are stored even if the print system 10 is turned off. In the nonvolatile memory 35, the unique information of the print system 10, various types of setting information, the correction data for correcting the density unevenness, and the like are stored.

The HDD 36 is a large-capacity nonvolatile storing device. In the HDD 36, print data, image data, data for printing test charts described later, and the like are stored.

The printer engine unit 40 has a function of printing an image (forming an image) on the recording paper. The printer engine unit 40 comprises the intermediate transfer belt 11, the image forming units 12Y, 12M, 12C and 12K, the paper feeding unit 13, the conveying unit 14, the fixing device 15, and the like that are shown in FIG. 1. The printer engine unit 40 operates on the basis of the control from the CPU 31.

The reading unit 18 comprises a light source for irradiating the recording paper passing through the reading position with light, a line image sensor for reading an image on the paper sheet line by line in the width direction of the recording paper (main scanning direction) by receiving the reflected light from the recording paper, and the like. The reading unit 18 repeats the operation of reading an image by one line in the width direction of the recording paper conveyed by the conveying unit 14 (main scanning direction). Thereby, the reading unit 18 reads the image formed on the recording paper conveyed in the sub-scanning direction, as a two-dimensional image. The reading width of the reading unit 18 in the main scanning direction may be optionally set as long as the test image (sub-scanning belt) which is described later can be read.

The operation panel unit 22 comprises a liquid crystal display (LCD), a touch panel that is provided on a screen of the liquid crystal display and that detects the coordinate position pressed by a pen, a finger or the like, an operation switch unit, such as a numerical keypad and a start key, and the like. The operation panel unit 22 displays various types of operation windows, setting windows and system state windows, and receives various types of operations such as job input and setting from a user.

The scanner unit 21 has the function of optically reading an image on the original to obtain image data. The scanner unit 21 comprises a light source for irradiating the original with the light, a line image sensor for reading an image on the original line by line in the width direction of the original by receiving the reflected light, a moving unit for sequentially moving the reading position line by line in the longitudinal direction of the original, an optical system having lenses, mirrors and the like for guiding the reflected light from the original to the line image sensor and focusing the reflected light on the line image sensor, a converting unit for converting an analog image signal outputted from the line image sensor into digital image data, and the like.

Further, the scanner unit 21 comprises an automatic document feeder that feeds the original sheet by sheet from a stack of the original, set on an original tray to convey the original via the reading position to a paper discharge position. The scanner unit 21 can successively read the original, having a plurality of sheets, which is set to the original tray.

The network I/F unit 37 communicates with an external device connected via a network such as a LAN (Local Area Network). For example, the network I/F unit 37 receives print data from the external device.

The image processing unit 38 performs the rasterization processing for converting print data into image data, compression/decompression processing of image data and the like, in addition to the processings, such as enlargement/reduction and rotation of the image. Further, in accordance with the correction data, the image processing unit 38 carries out the process of correcting the density unevenness in the main scanning direction and in the sub-scanning direction, for the image data to be printed out by the printer engine unit 40.

The print system 10 successively prints the test images for measuring the density unevenness in the sub-scanning direction, on a plurality of sheets of recording paper. Then, in the print system 10, the measuring data obtained by optically reading the test images printed on a plurality of sheets of recording paper (data indicating the density of the read test image), are arranged in the printing order apart from each other so as to correspond to the intervals of the sheets of recording paper. By analyzing the measuring data, the density unevenness in the sub-scanning direction, which has a period longer than the length of one sheet of recording paper, is detected.

Figure 3A:
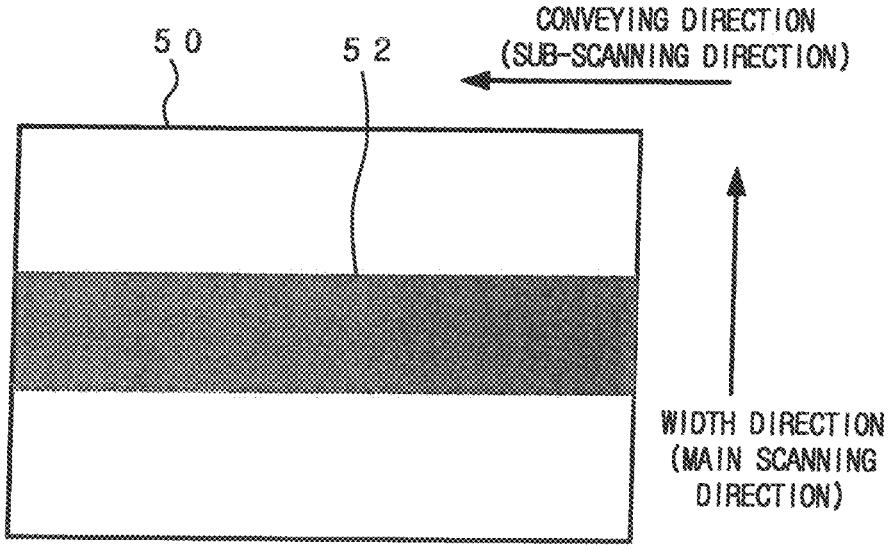
FIGS. 3A and 3B are views showing an example of the test charts for measuring the density unevenness in the sub-scanning direction.

FIG. 3A shows an example of the recording paper (test chart) 50 on which a test image 52 for measuring the density unevenness in the sub-scanning direction is printed. The test image 52 (also referred to as "sub-scanning belt") having the evenness density is printed in a belt form having a predetermined width extending in the main scanning direction, throughout the entire length extending in the sub-scanning direction of the recording paper 50 (from the front end to the rear end). The width of the sub-scanning belt 52 may be set so as to be thinner than the sub-scanning belt 52 shown in the drawings as long as the density of the sub-scanning belt 52 can be measured. The sub-scanning belt 52 is not required to be arranged on the middle of the recording paper in the width direction, and may be arranged on the position corresponding to the reading position of the reading unit 18.

Figure 3B:
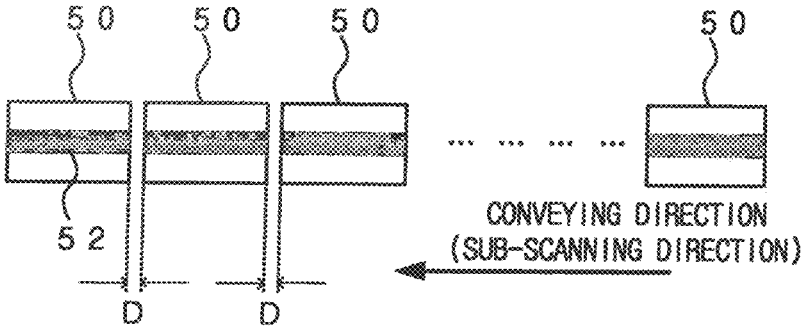

FIG. 3B shows the situation in which a plurality of test charts 50 which are successively printed are arranged at the intervals D at which the sheets of the recording paper are conveyed.

Figure 4:
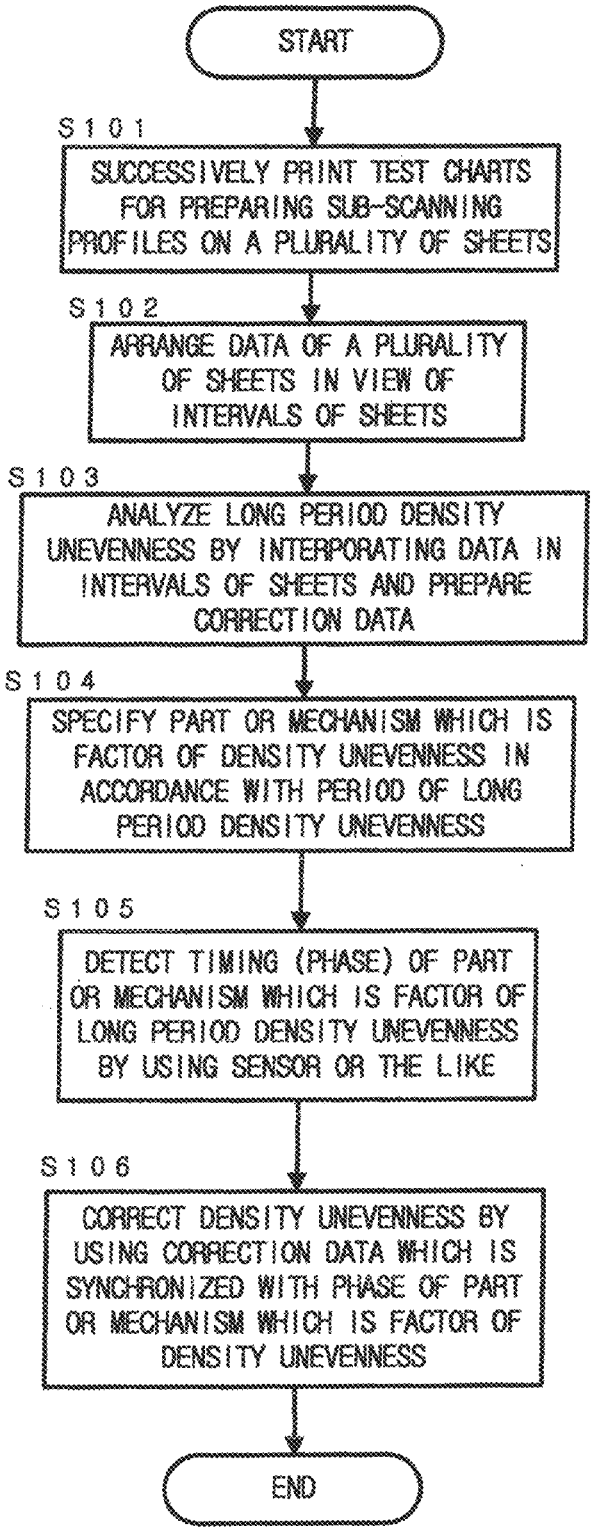
FIG. 4 is a flowchart showing the process for measuring and correcting the long period density unevenness in the sub-scanning direction in the print system according to the embodiment.

FIG. 4 shows the process for measuring and correcting the long period density unevenness in the sub-scanning direction in the print system 10. Firstly, a plurality of test charts 50 on which the test images 52 are printed, are successively printed out (Step S101). At this time, the test image 52 of each test chart 50 is optically read by the recording unit 18 to obtain the measuring data indicating the density of the test image 52. Then, the profile for indicating the density unevenness in the sub-scanning direction is prepared in each recording paper.

The number of the sheets of the test charts 50 to be output is set so as to obtain the data having the distance which is longer than the period of the part having the longest period among the parts of the print system 10, which could influence the density unevenness in the sub-scanning direction. For example, in case that the intermediate transfer belt 11 is a part having the longest period and has the length of 2 m, when the length of one test chart 50 is 0.5 m and the interval of the sheets of the test charts 50 is 0.1 m, at least four test charts 50 (0.5 m×4+0.1 m×3=2.3 m) are successively printed out.

In this case, in order to correct both of the long period density unevenness in the sub-scanning direction, which has the period longer than the length of one sheet of the recording paper, and the short period density unevenness in the sub-scanning direction, which has the period shorter than the length of one sheet of the recording paper, the measuring data are sampled at the sampling interval corresponding to the short period density unevenness in the sub-scanning direction. The measuring data may be separately sampled at each of the sampling intervals which correspond to the long period density unevenness and the short period density unevenness. The sampling of the measuring data will be explained below.

Figure 5:
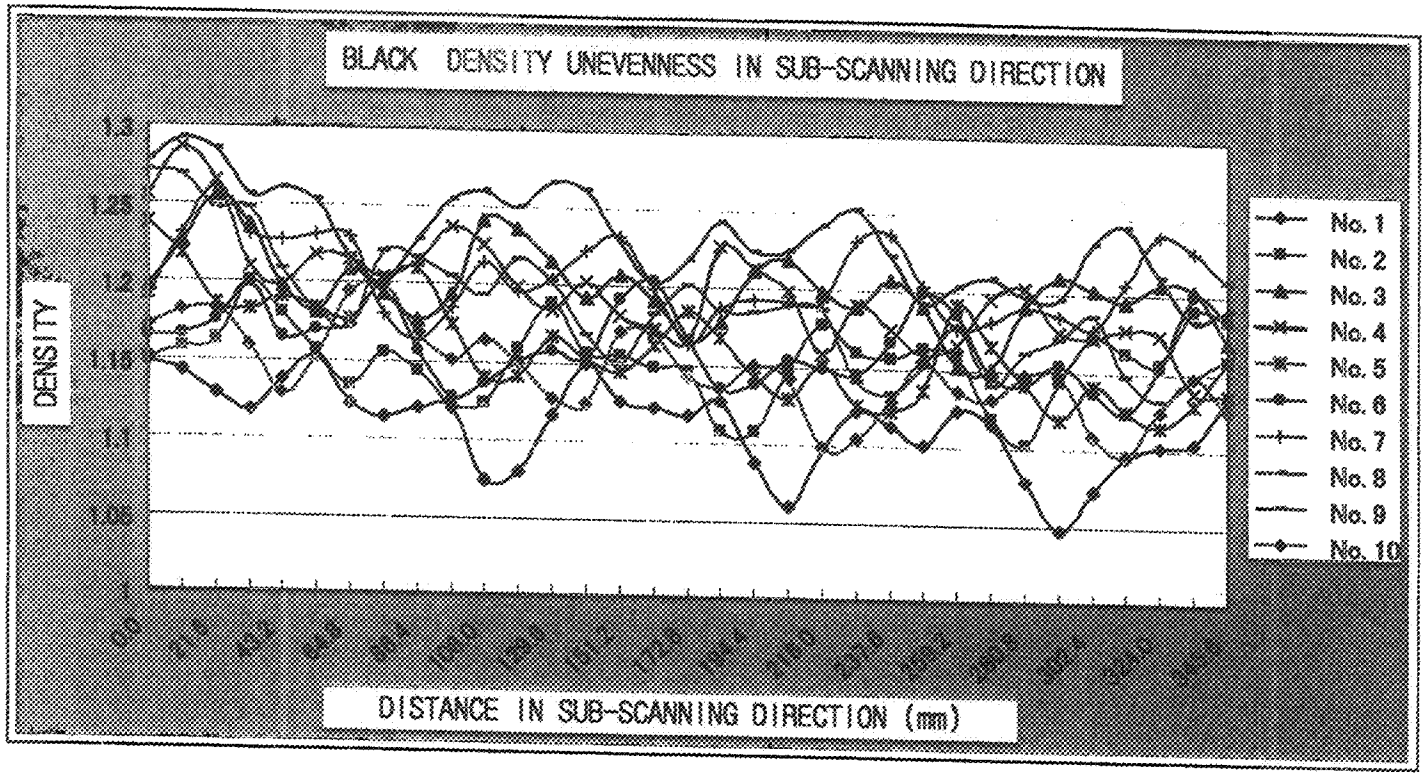
FIG. 5 is a view showing the profiles for ten test charts which are successively printed, so as to overlap the profiles.

FIG. 5 shows the graph of the profiles of the measuring data relating to ten test charts so as to overlap the profiles.

Figure 6A:
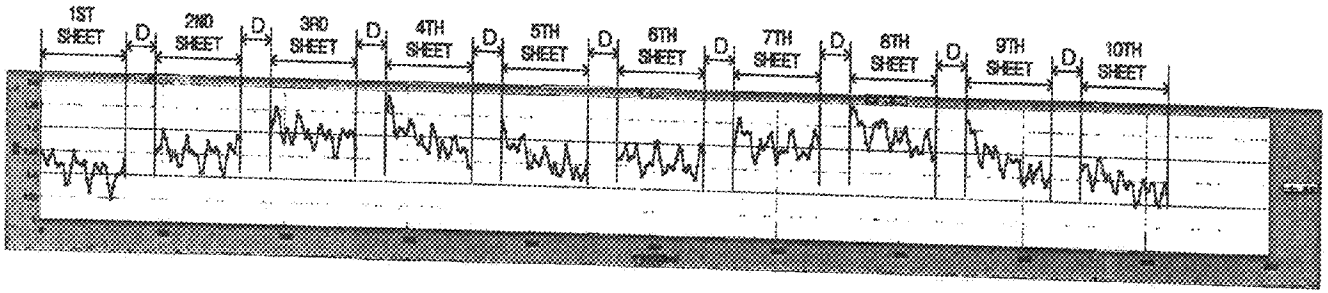

In FIG. 4, the profiles for the test charts obtained in Step S101 are arranged in the printing order apart from each other so as to correspond to the intervals D of the sheets of recording paper (Step S102). The arranged profiles are shown in FIG. 6A.

The distance of the interval D can be calculated by the number of sheets of the test charts 50 which are printed out in unit time, the convey speed of the recording paper and the length of the test chart 50. For example, in case that the number of the sheets on which the charts are printed in 1 minute is 30, the length of the test chart 50 is 0.5 m and the convey speed is 0.3 m/sec, the interval D is calculated by the equation (0.3 m/sec×60 sec−0.5 m×30)/(30−1)=0.1034 m.

The data which are positioned in the intervals D are interpolated. By analyzing one graph obtained by interpolating the data, the long period density unevenness in the sub-scanning direction is extracted. Then, the correction data for cancelling the extracted long period density unevenness is obtained (Step S103 in FIG. 4).

As a method for interpolating the data positioned in the intervals D, for example, (1) the data is interpolated by a straight line, (2) the front end of the next recording paper is connected with the rear end of the previous recording paper by extending the fluctuation of the density near the rear end of the previous recording paper, and the like. The data may be interpolated by an optional method. Even though the data is simply interpolated by a straight line, the interval D is sufficiently short as compared with the period of the long period density unevenness in the sub-scanning direction. Therefore, the analysis of the long period density unevenness in the sub-scanning direction is hardly influenced.

Figure 6B:
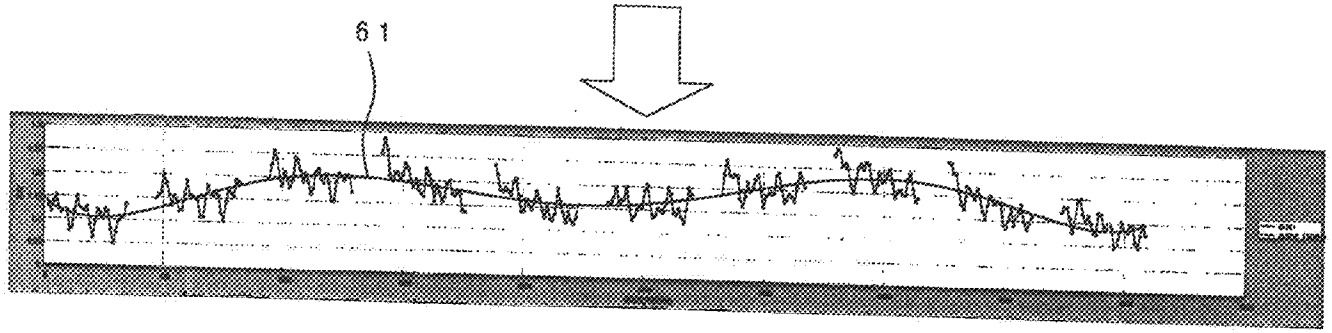

As described above, by carrying out the frequency analysis for one graph obtained by interpolating the data, the long period density unevenness in the sub-scanning direction is calculated. FIG. 6B shows the graph 61 of the extracted long period density unevenness in the sub-scanning direction so as to overlap the data shown in FIG. 6A.

Figure 6C:
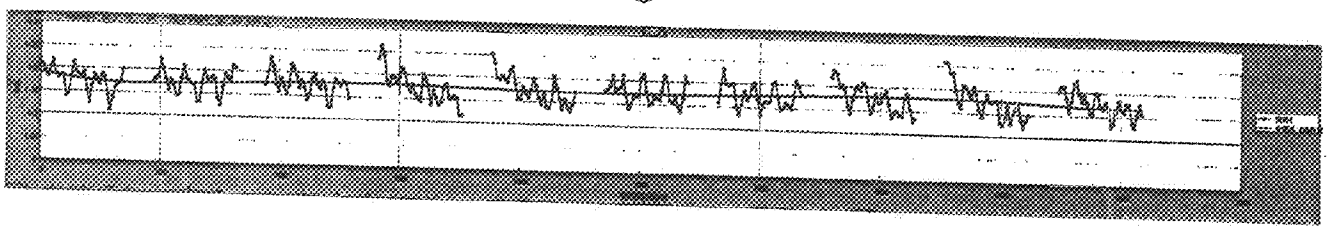

The correction data for cancelling the above long period density unevenness in the sub-scanning direction (the correction data for flatting the graph by being superposed on the long period density unevenness in the sub-scanning direction) is prepared. FIG. 6C shows the situation in which the data shown in FIG. 6A is corrected by using the correction data.

The characteristic of the long period density unevenness in the sub-scanning direction may be obtained as an approximate curve from the data of a plurality of program files arranged apart from each other so as to correspond to the intervals D, without interpolating the data in the intervals D.

Next, in accordance with the period of the long period density unevenness in the sub-scanning direction, the parts or the mechanisms which are the factors of the long period density unevenness, are specified (Step S104 in FIG. 4). For example, in case that the factor of the long period density unevenness is the intermediate transfer belt 11, the length of the period of the long period density unevenness is approximately coincident with the length of the intermediate transfer belt 11.

In this case, the parts and the mechanisms which can be the factors of the long period density unevenness, are previously picked up. The length of the period of each of the parts and the mechanisms which can be the factors of the long period density unevenness, is estimated. A table in which each factor is related to each estimated length is previously prepared and stored. Then, by referring the table, the factor of the long period density unevenness in the sub-scanning direction is specified.

The factors of the long period density unevenness include various types of rollers for supporting the intermediate transfer belt 11 or forming the conveying passage, a development sleeve for stirring the toner in the developing device, the photoconductive drum 16, the switching on/off of a heater of the fixing device and the like, in addition to the above-described intermediate transfer belt 11.

When the test charts 50 are successively printed in Step S101, the phase of the periodic motion of each of the parts and the mechanisms which can be the factors of the density unevenness in the sub-scanning direction is detected by a sensor and is related to the measuring data. With respect to the on/off control carried out for the heater of the fixing device by the CPU 31, the timing information of the on/off control is related to the measuring data.

For example, a sensor for detecting that the specific portion of the intermediate transfer belt 11 reaches the secondary transfer position Q, is provided. The CPU 31 relates the detecting timing at which the sensor detects that the specific portion of the intermediate transfer belt 11 reaches the secondary transfer position Q, to the measuring data obtained by reading the portion of the test image 52 of the recording paper with the reading unit 18, which is positioned on the secondary transfer position Q at the detecting timing.

Figure 7:
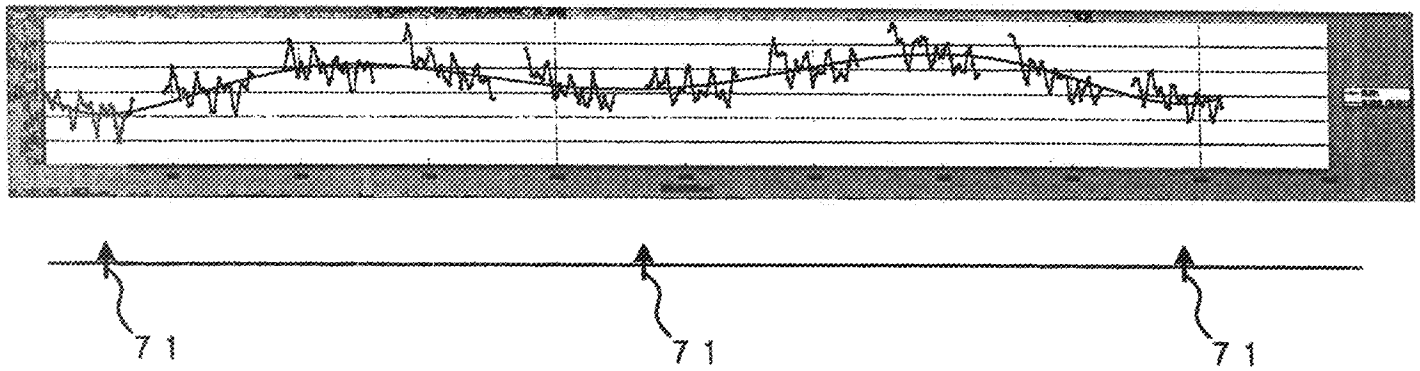
FIG. 7 is a view showing the profiles which are arranged in view of the intervals of the sheets of recording paper, so as to be related to the timings at which the specific portion reaches the secondary transfer position.

FIG. 7 shows the profiles which are arranged in view of the intervals of the sheets of recording paper, so as to be related to the timings 71 at which the specific portion reaches the secondary transfer position Q. Thereby, the phase relation between the position of the intermediate transfer belt 11 and the period of the density unevenness in the sub-scanning direction, which is caused due to the intermediated transfer belt 11, is grasped. In the correction data prepared in Step S103, the information indicating the identification name of the part or the mechanism which is the factor of the long period density unevenness in the sub-scanning direction, to be corrected by using the prepared correction data and the phase relation, is added.

When the normal printing is carried out, the CPU 31 corrects the long period density unevenness in the sub-scanning direction by using the above correction data (Steps S105 and S106 in FIG. 4). From the information added to the correction data, the CPU 31 recognizes the part or the mechanism which is the factor of the long period density unevenness in the sub-scanning direction, and detects the driving timing (phase) of the recognized part or mechanism by using the sensor or the like (Step S105). Then, by applying the correction data so as to be synchronized with the phase of the recognized part or mechanism, the CPU 31 corrects the long period density unevenness in the sub-scanning direction, which is caused due to the recognized part or mechanism (Step S106). In this correction, for example, the density value of the image data to be printed is corrected by using the correction data which is synchronized with the phase.

As described above, a plurality of test charts 50 are successively output, and the profiles for the test charts 50, which indicate the density unevenness in the sub-scanning direction, are prepared by reading the test charts 50, and are analyzed by arranging them apart from each other so as to correspond to the intervals D of the sheets of the test charts 50. Therefore, it is possible to detect and correct the long period density unevenness in the sub-scanning direction, which is not contained in one sheet of the recording paper.

Further, because the test image is printed on actual recording paper, it is possible to obtain the test charts 50 in which the density unevenness caused due to all of the factors relating to the printing, is indicated. Therefore, it is possible to correct the density unevenness caused due to all of the factors. In case that the test image is formed on the intermediate transfer belt 11 as the toner image and the profile is prepared by optically reading, the toner image, it is not possible to measure the influence of the density unevenness caused after the toner image is transferred from the intermediate transfer belt 11 to the recording paper. For example, the measuring data on which the density unevenness in the sub-scanning direction, which is caused at the fixing, or the difference in the characteristic of the density unevenness according to the type of paper is reflected, cannot be obtained. The correction for the above density unevenness cannot be carried out.

Further, in the embodiment, because the final output image which is printed on the recording paper is measured to correct the density unevenness, it is possible to accurately separate and recognize the factors of the density unevenness. For example, even though both of the long period density unevenness in the sub-scanning direction, which is caused due to the intermediate transfer belt 11 and the long period density unevenness in the sub-scanning direction, which is caused due to the fixing device are simultaneously caused, it is possible to separate and extract the long period density unevenness according to each factor. In case that the profile is prepared from the toner image formed on the intermediate transfer belt 11, the recording paper can be saved. However, as described above, it is not possible to accurately separate the factors of the density unevenness. Therefore, the density unevenness in the sub-scanning direction cannot be precisely corrected.

Next, the method for measuring the interval of the sheets will be exemplified.

Figure 8:
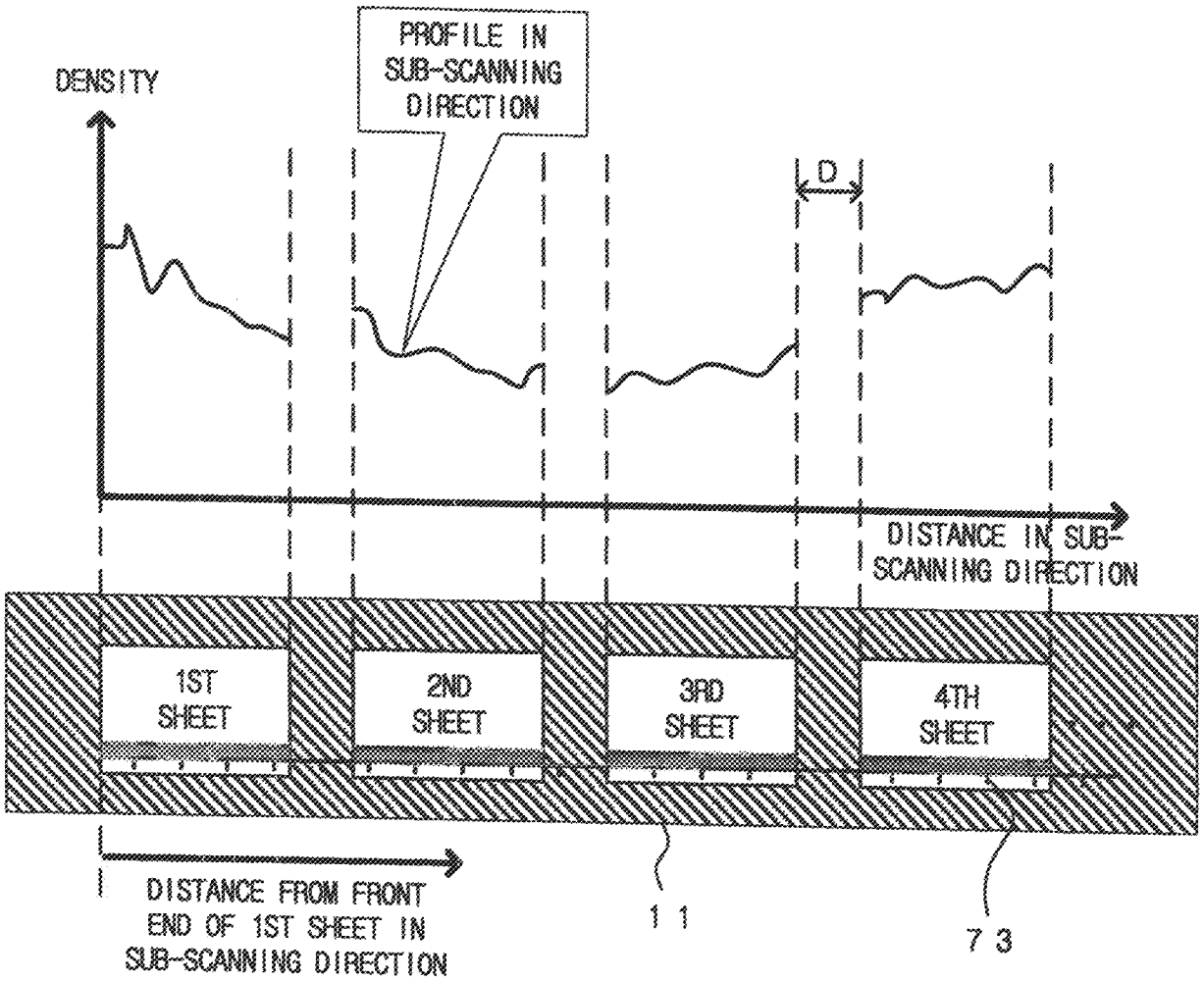
FIG. 8 is an explanatory view showing the situation in which the marks are put on the intermediate transfer belt at the constant interval which does not depend on the timing of conveying the recording paper.

In this embodiment, the marks are printed on the recording paper as scales. In detail, as shown in FIG. 8, the marks 73 are put on the image carrier, such as the intermediate transfer belt 11, the photoconductive drum 16 or the like, at the constant interval which does not depend on the timing of conveying the recording paper. The marks 73 are printed so as to add the serial numbers. The marks 73 function as the graduated scale disposed on a plurality of test charts arranged at the interval of the sheets, so as to traverse the above intervals.

Figure 9A:
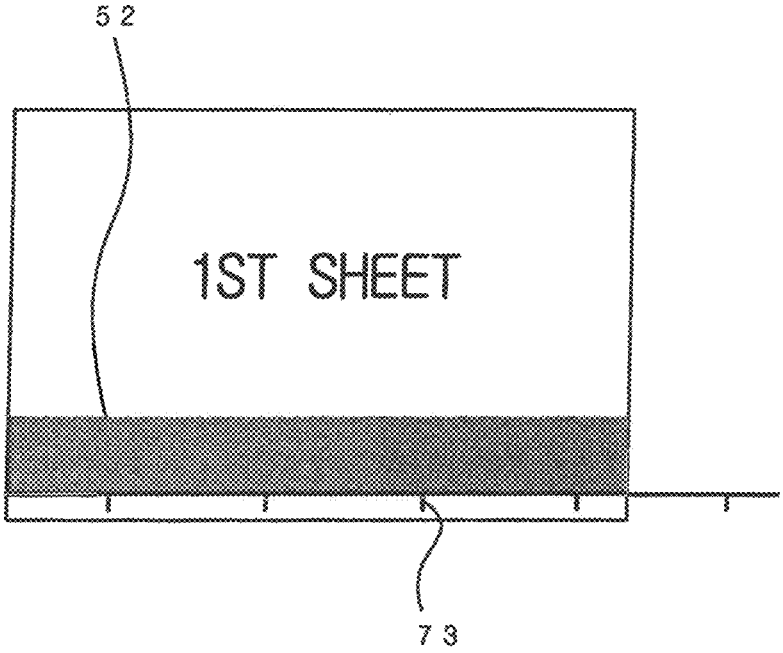
FIGS. 9A and 9B are explanatory views showing an example of the case in which the interval of the sheets is calculated in accordance with the marks put on the recording paper.

FIG. 9A shows the sub-scanning belt 52 printed on the first sheet of the recording paper and the marks 73 (scale) printed along the sub-scanning belt 52.

Figure 9B:
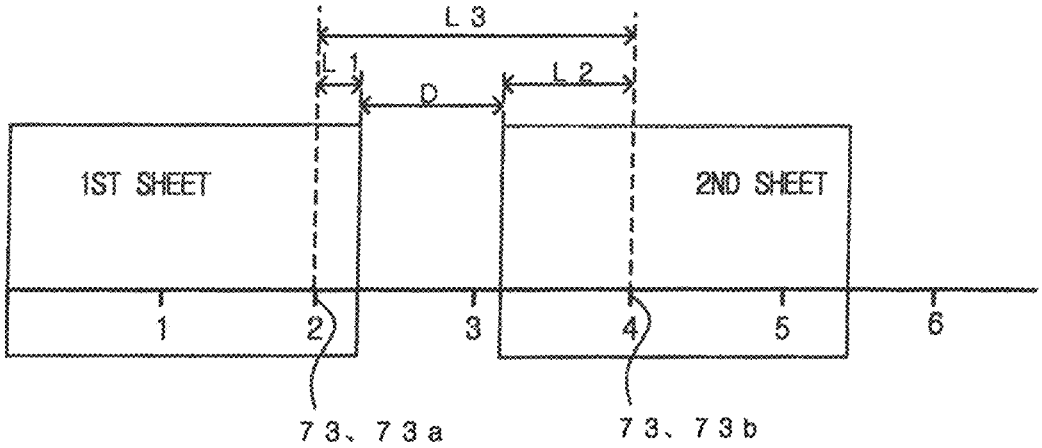

FIG. 9B shows the situation, in which the interval between the first sheet and the second sheet is calculated by using the mark 73 which is printed on the first sheet of the recording paper and the mark 73 which is printed on the second sheet of the recording paper. From the distance L1 from the mark 73*a* indicating the number "2" which is the closest to the rear end of the first sheet in the marks 73 printed on the first sheet, to the rear end of the first sheet, the distance L2 from the mark 73*b* indicating the number "4" which is the closest to the front end of the second sheet in the marks 73 printed on the second sheet, to the front end of the second sheet and the distance L3 from the mark 73*a* indicating the number"2" to the mark 73*b* indicating the number "4", the interval D of the sheets can be calculated by the equation D=L3−L1−L2. In case that the interval of the sheets is roughly known, the precise interval can be calculated even though the numbers are not attached to the marks 73.

Figure 10:
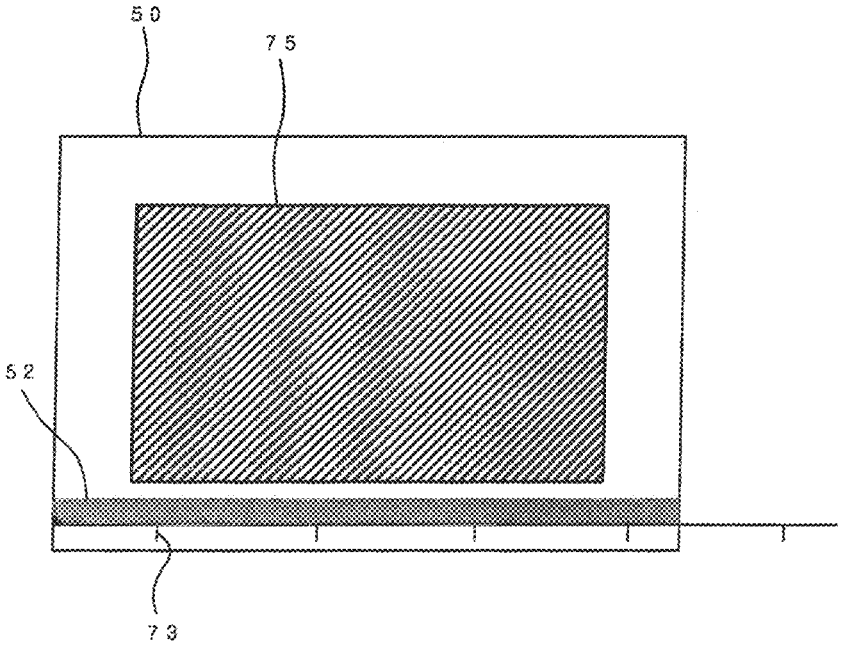
FIG. 10 is a view showing an example of the case in which the sub-scanning belt and the marks are printed out of the effective image area on the recording paper.

The sub-scanning belt 52 and the marks (scale) 73 and the like for preparing the profile of the density in the sub-scanning direction may be printed on a portion except the effective image area 75 of the recording paper as shown in FIG. 10. The effective image area 75 is an area in which the normal print image is printed. For example, the outside area of the effective image area 75 is an area which is removed by being trimmed and an area in which the crop marks for positioning the trimming position are printed.

In case that the sub-scanning belt 52 and the marks 73 are printed in the portion except the effective image area 75, it is possible to obtain the profiles for measuring the density unevenness in the sub-scanning direction when the user instructs the print system 10 to carry out the normal printing. Thereby, the recording paper can be saved as compared with the case in which the test chart is printed on the separate recording paper. Further, because the profiles can be obtained during the normal printing to measure the density unevenness, when the situation of the caused density unevenness is changed, the correction data can be immediately updated to correct the caused density unevenness.

Next, the case in which both of the long period density unevenness in the sub-scanning direction and the short period density unevenness in the sub-scanning direction are corrected, will be explained.

Figure 11:
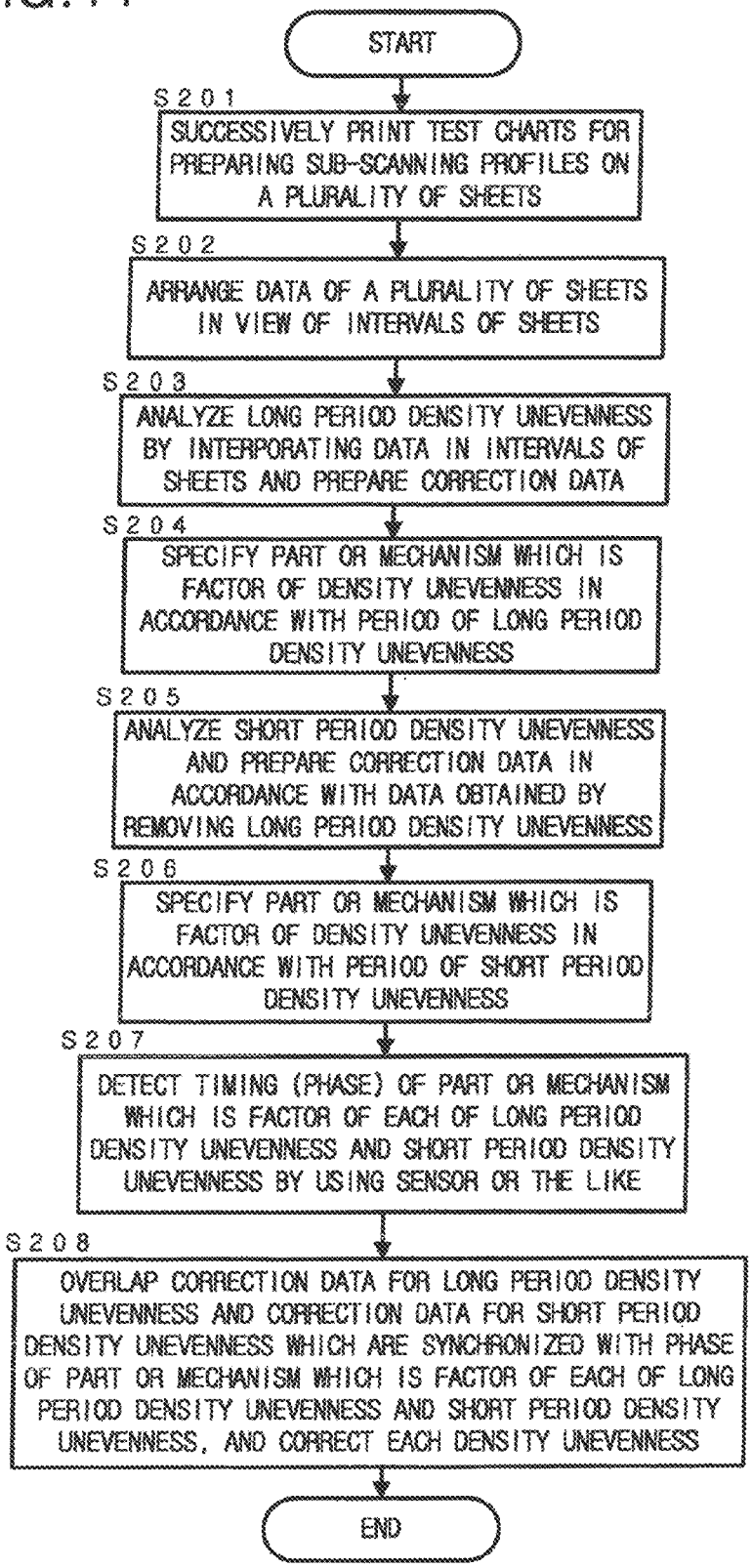
FIG. 11 is a flowchart showing the process for measuring and correcting the long period density unevenness and the short period density unevenness in the sub-scanning direction in the print system according to the embodiment.

FIG. 11 shows the process in the above case. The Steps S201 to S204 are the same as the Steps S101 to S104 shown in FIG. 4. The explanations thereof are appropriately omitted.

By arranging and analyzing the profiles obtained by reading a plurality of test charts 50 which are successively printed, the long period density unevenness in the sub-scanning direction is extracted and the correction data for the extracted density unevenness is prepared (Steps S201 to S203). Then, from the length of the period of the long period density unevenness in the sub-scanning direction, the part or the mechanism which is the factor of the long period density unevenness is specified (Step S204).

Next, by correcting the profiles by using the prepared correction data, the data obtained by removing the long period density unevenness in the sub-scanning direction from the profiles is prepared. Then, the short period density unevenness in the sub-scanning direction is extracted in accordance with the data obtained by removing the long period density unevenness, and the correction data for the short period density unevenness is prepared (Step S205). As a method for extracting the short period density unevenness in the sub-scanning direction and preparing the correction data for the short period density unevenness, a known method may be used.

Next, from the length of the period of the short period density unevenness in the sub-scanning direction, the part or the mechanism which is the factor of the short period density unevenness is specified (Step S206). When the test charts are successively printed in Step S201, the phase of the periodic motion of each of the parts and the mechanisms which can be the factor of the long period density unevenness in the sub-scanning direction or the factor of the short period density unevenness in the sub-scanning direction, is detected by a sensor, and is related to the measuring data. In each of the correction data prepared in Steps S203 and S205, the information indicating the identification name of the part or the mechanism which is the factor of the long period density unevenness or the short period density unevenness in the sub-scanning direction, to be corrected by the prepared correction data and the phase relation, is added.

When the normal printing is carried out, the CPU 31 corrects the long period density unevenness and the short period density unevenness in the sub-scanning direction by using the above correction data for the long period density unevenness and the above correction data for the short period density unevenness (Steps S206 to S208). At this time, from the information added to each of the correction data the CPU 31 recognizes the part or the mechanism which is the factor of the long period density unevenness and the part or the mechanism which is the factor of the short period density unevenness, respectively, and detects the driving timing (phase) of the recognized part or mechanism by using the sensor (Step S207).

Then, the CPU 31 prepares the synthesized correction data obtained by overlapping the correction data for the long period density unevenness, which is synchronized with the phase of the part or the mechanism which is the factor of the long period density unevenness in the sub-scanning direction, and the correction data for the short period density unevenness, which is synchronized with the phase of the part or the mechanism which is the factor of the short period density unevenness in the sub-scanning direction. By using the synthesized correction data, the CPU 31 corrects the long period density unevenness and the short period density unevenness in the sub-scanning direction, which are caused due to the recognized part or mechanism (Step S208). In this correction, the density value of the image data to be printed is corrected by using the synthesized correction data which is synchronized with the phases.

As described above, the long period density unevenness in the sub-scanning direction is detected from the profiles arranged in view of the intervals of the sheets. The data is prepared by removing the long period density unevenness from the profiles. Then, the short period density unevenness in the sub-scanning direction is removed by analyzing the data prepared by removing the long period density unevenness. Therefore, it is possible to accurately remove the long period density unevenness and the short period density unevenness in the sub-scanning direction. That is, it is hard to influence the analysis and the detection of the long period density unevenness in the sub-scanning direction by the short period density unevenness in the sub-scanning direction. On the other hand, it is easy to influence the analysis and the detection of the short period density unevenness in the sub-scanning direction by the long period density unevenness in the sub-scanning direction. Therefore, by previously detecting and removing the long period density unevenness in the sub-scanning direction, it is possible to more precisely detect and correct the short period density unevenness in the sub-scanning direction.

Next, the case in which the long period density unevenness and the short period density unevenness in the sub-scanning direction are corrected after removing the density unevenness in the sub-scanning direction, which is always caused on the same position in the recording paper, will be explained.

Figure 12A:
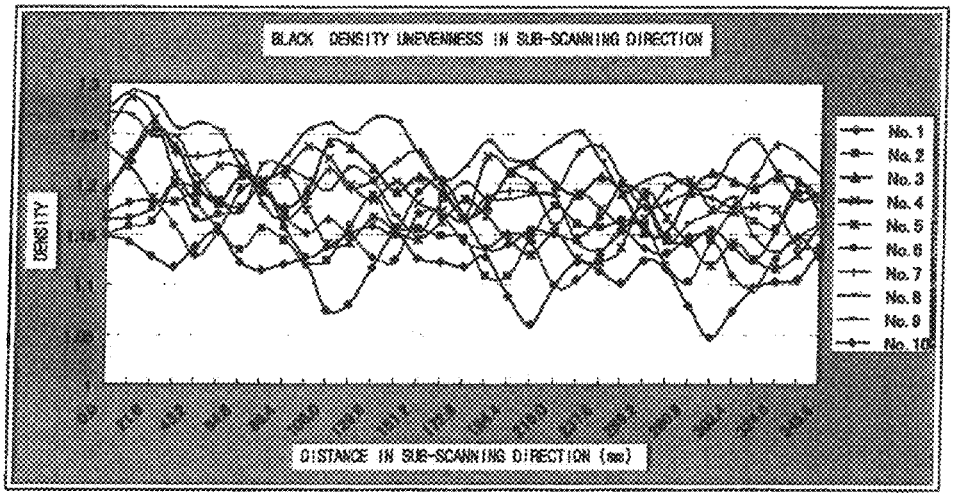
FIGS. 12A and 12B are the profiles relating to ten test charts which are successively printed and the profile (in-page incline) in which the profiles relating to ten test charts are averaged in one sheet of recording paper.
Figure 12B:
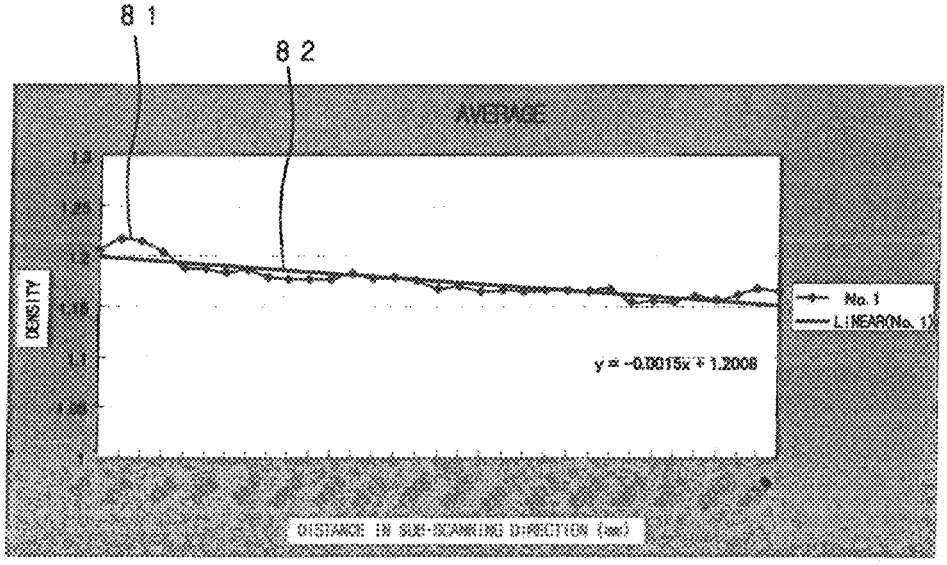

The density unevenness in the sub-scanning direction includes the density unevenness caused on the constant position in the recording paper. For example, by averaging the profiles relating to ten test charts which are successively printed and having the same length from the front end of the recording paper as shown in FIG. 12A, the averaged profile (FIG. 12B) is prepared in one sheet of the recording paper. In the averaged profile, the long period density unevenness and the short period density unevenness in the sub-scanning direction are removed, that is, the influence due to the density unevenness in the sub-scanning direction which does not depend on the position in the page, is eliminated. In the averaged profile, only the density unevenness (in-page density distribution) which depends on the position in the page is shown. In the example shown in FIG. 12B, a gentle density incline (in-page incline) is shown from the front end to the rear end of one sheet of recording paper. In FIG. 12B, the graph 81 of the averaged profile and the graph 82 which is obtained by approximating the graph 81 by a line, are shown.

By previously detecting and removing the density unevenness in the sub-scanning direction (in-page density distribution) which depends on the position in the page, the accuracy of the analysis and the correction of the long period density unevenness in the sub-scanning direction, which are carried out after removing the in-page density distribution can be improved.

Figure 13:
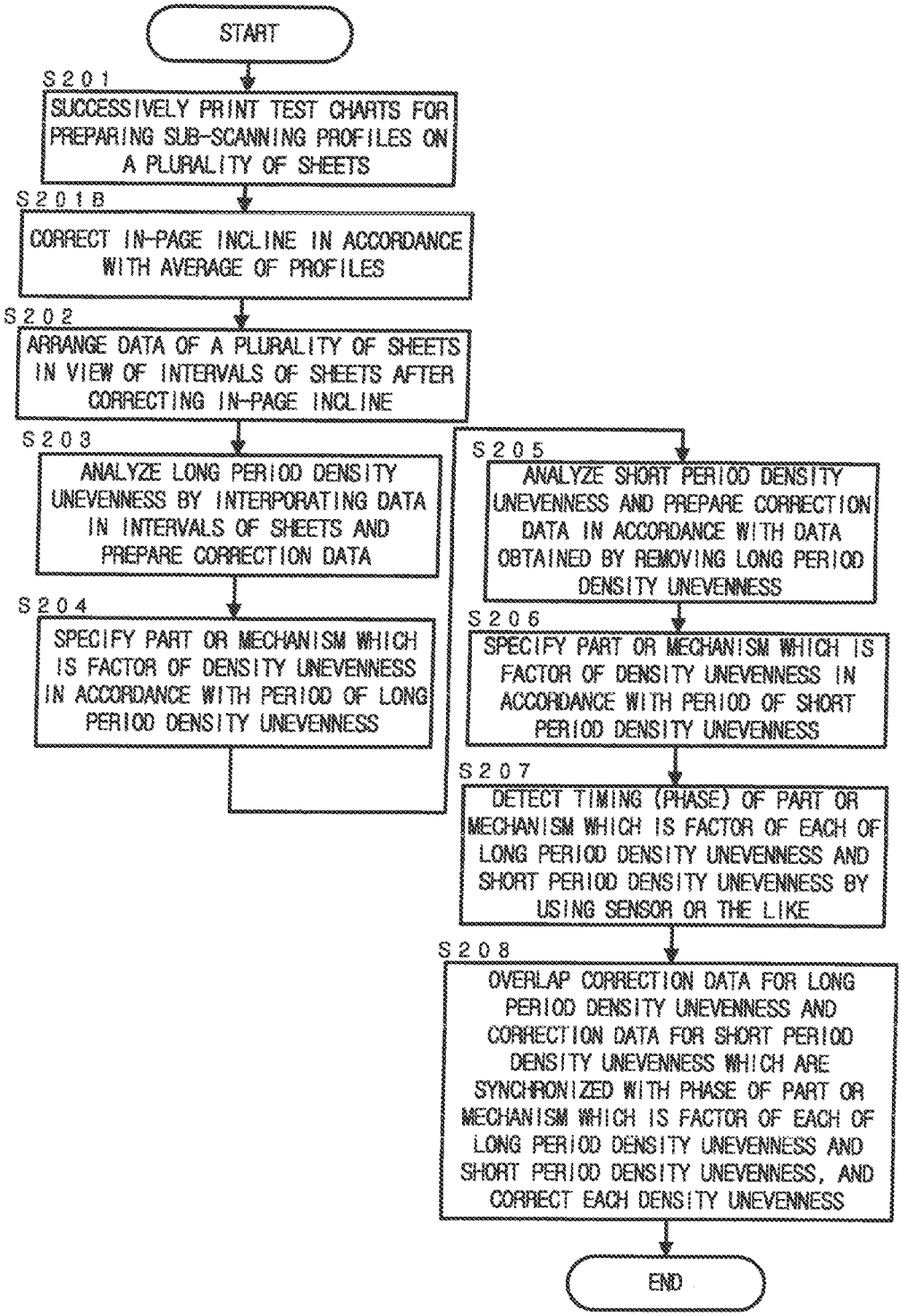
FIG. 13 is a flowchart showing the process for correcting the long period density unevenness and the short period density unevenness in the sub-scanning direction after the density unevenness in the sub-scanning direction, which is always caused on the same position in the recording paper, is removed.

FIG. 13 shows the process for correcting the long period density unevenness and the short period density unevenness in the sub-scanning direction after the density unevenness in the sub-scanning direction, which is always caused on the same position in the recording paper, is removed. In FIG. 13, the steps which are the same as those of the flowchart shown in FIG. 11 are denoted by the same step numbers as those of FIG. 11. The difference between the flowcharts of FIG. 11 and FIG. 13 is that Step S201B is inserted between Step S201 and Step S202 in FIG. 13.

In Step S201B, by averaging the profiles relating to a plurality of test charts 50 which are successively printed and having the same length from the front end of the recording paper, the averaged profile is prepared in one sheet of the recording paper. Then, by analyzing the averaged profile, the density unevenness in the sub-scanning direction, which is always caused on the same position in the recording paper, is calculated. In this case, as shown in FIG. 12B, the in-page incline is caused, and the graph is obtained by approximating the in-page incline by a line.

Next, the data which is corrected so as to cancel the in-page incline in each profile, is obtained.

In Step S202 and the following steps, the process is carried out by using the profiles in which the in-page incline is corrected.

Figure 14:
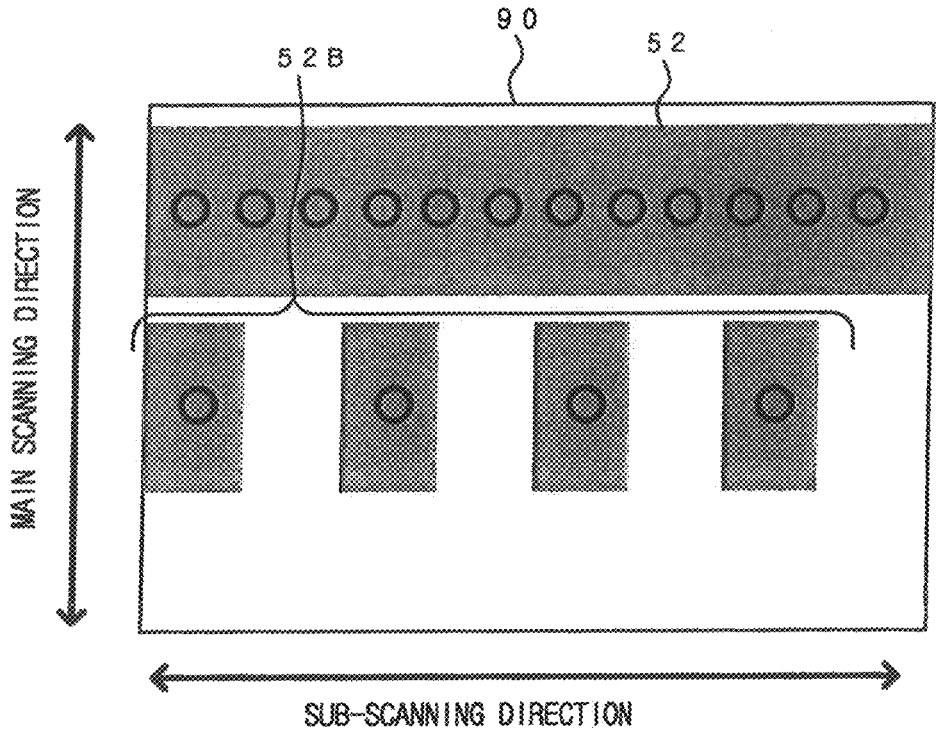
FIG. 14 is a view showing the test image and the sampling timings thereof in case that the profiles corresponding to the long period density unevenness and the short period density unevenness in the sub-scanning direction, are prepared.
Figure 15:
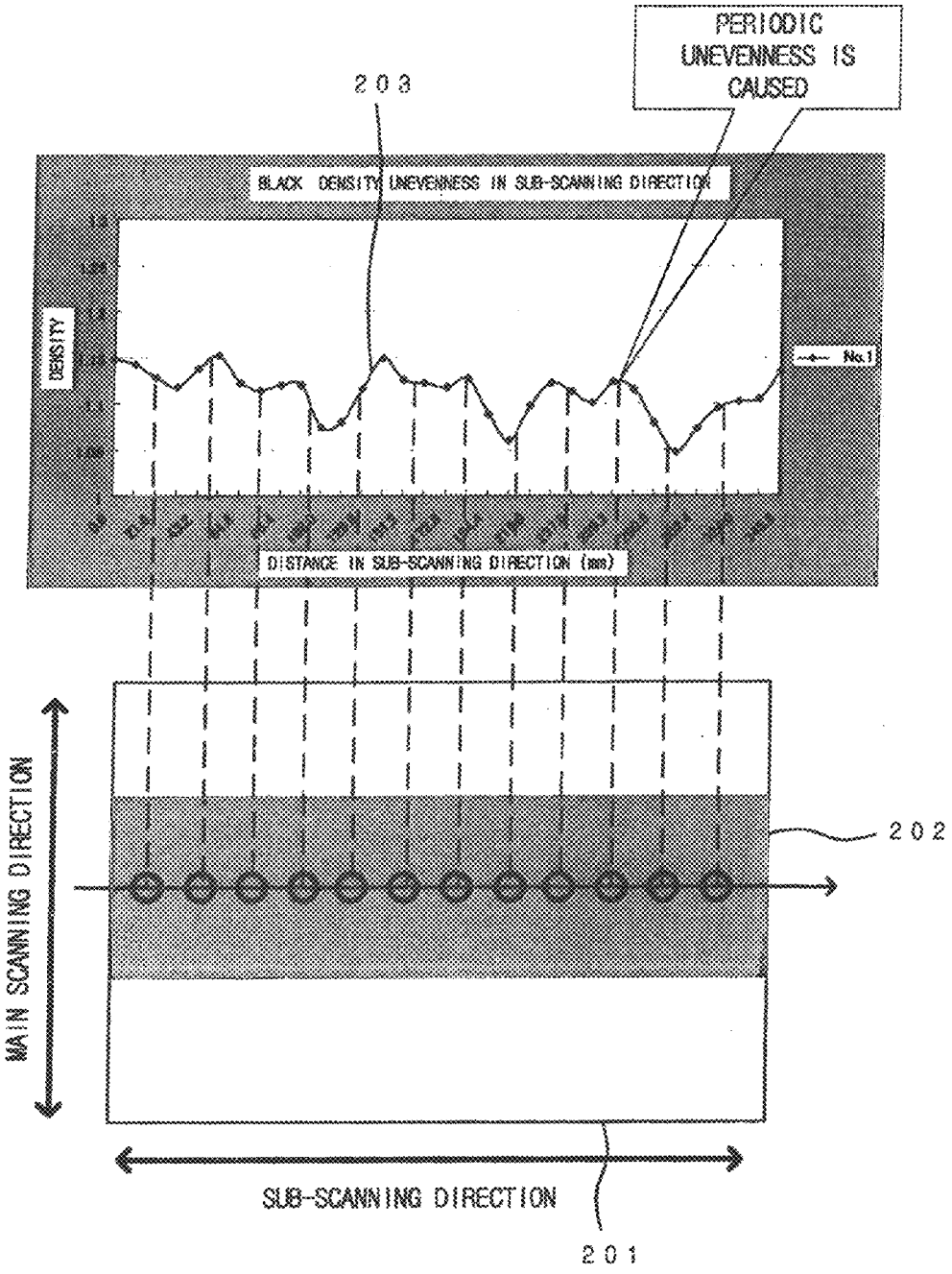
FIG. 15 is a view showing the density unevenness in the sub-scanning direction, which is caused in one sheet of recording paper, and the sampling timings thereof.

Next, in case that the long period density unevenness and the short period density unevenness in the sub-scanning direction are measured, the test chart and the sampling thereof will be explained by using FIG. 14.

In case that the shape of the short period density unevenness in the sub-scanning direction is measured, it is required to measure the density unevenness by a fine pitch to a certain degree. For example, in case that the period of the short period density unevenness in the sub-scanning direction is 20 cm, in order to accurately measure the density unevenness, it is preferable to set at least five sampling points (measurement points) within the range of 20 cm. On the upper side of the test chart 90 shown in FIG. 14, the test image (sub-scanning belt) 52 for measuring the short period density unevenness in the sub-scanning direction and the sampling pattern thereof are shown. The circles shown in the drawing indicate the sampling points.

In case of the long period density unevenness in the sub-scanning direction, it is possible to use the test image 52 for measuring the short period density unevenness in the sub-scanning direction and the sampling pattern thereof as they are. However, the sampling may be carried out by a rougher pitch. For example, when about four sampling points are set in one sheet of the recording paper, it is possible to measure the shape of the long period density unevenness in the sub-scanning direction. In the test chart 90 of FIG. 14, the second test image 52B which is shown below the test image 52 is a test image for measuring the long period density unevenness in the sub-scanning direction. In the second test image 52B, each density patch is printed only in the portion of the sampling point for the long period density unevenness, which is set by a rough pitch.

In accordance with the period of the density unevenness in the sub-scanning direction to be measured, the type of the test image and the sampling pattern may be automatically changed. For example, in case that only the long period density unevenness in the sub-scanning direction is corrected, the type of the test image and the sampling pattern may be automatically changed so as to measure the density unevenness by using the second test pattern 52B shown in FIG. 14 at the rough sampling pattern. In case that both of the long period density unevenness and the short period density unevenness in the sub-scanning direction are corrected, the type of the test image and the sampling pattern may be automatically changed so as to measure the long period density unevenness and the short period density unevenness by using the test pattern 52 shown in FIG. 14 at the fine sampling pattern. Further, in case that both of the long period density unevenness and the short period density unevenness in the sub-scanning direction are corrected, the measurement for the long period density unevenness in the sub-scanning direction is carried out by using the second test image 52B at the rough sampling pattern, and the measurement for the short period density unevenness in the sub-scanning direction is carried out by using the test image 52 at the fine sampling pattern, respectively.

As described above, the embodiment is explained by using the drawings. However, in the present invention, the concrete configuration is not limited to the above embodiment. In the present invention, various modifications of the above embodiment or the addition of various functions or the like to the embodiment can be carried out without departing from the gist of the invention.

In the print system 10 according to the embodiment, the test chart 50 is read by the reading unit 18 disposed on the conveying passage of the subsequent stage of the fixing device 15. However, for example, a user may set the stack of a plurality of printed test charts 50 on the original tray of the scanner unit 21, and the profiles may be prepared by reading the test charts 50 with the scanner unit 21. Further, the measuring data obtained by reading the test charts 50 with an external reading device may be received via the network I/F unit 37 or the like to prepare the profiles.

Further, in the embodiment, the print system 10 comprising the reading unit 18 and the printer engine unit 40 as a united device, is described. However, the device for preparing the correction data may be constructed as an image processing device. That is, the device for preparing the correction data may be constructed as an image processing device having a function of instructing a predetermined print device to successively print a plurality of test charts 50 (sample output unit); a function of preparing profiles by inputting measuring data obtained by reading a plurality of printed test charts 50 with an external reading device (profile preparing unit); a function of analyzing the profiles by arranging them in view of the intervals of the sheets and detecting the long period density unevenness and the short period density unevenness in the sub-scanning direction (analyzing unit); and a function of preparing the correction data for removing the detected long period density unevenness and the detected short period unevenness in the sub-scanning direction (correction data preparing unit). Alternatively, the above image processing device may further have a function of specifying a factor of each period of density unevenness (factor specifying unit). The prepared correction data is input to the print device and is used for correcting the density unevenness in the sub-scanning direction.

The test image is not limited to the image exemplified in the embodiment. For example, a plurality of sub-scanning belts having different densities from each other may be printed on one sheet of recording paper. In this case, it is possible to measure the density unevenness in the sub-scanning direction with respect to a plurality of densities at once.

The update of the correction data is preferably carried out at the timing when the density unevenness in the sub-scanning direction is changed. For example, when a curtain amount of component degradation is caused, when parts are exchanged, or when the environment change is caused above a certain level, the correction data is preferably updated.

The image forming method is not limited to the electrophotographic method which is exemplified in the embodiment. An ink jet method or the like may be used.

One of the objects of the above embodiment is to provide an image processing device, an image processing method and a print system, which can correct the long period density unevenness in the sub-scanning direction, which extends through a plurality of sheets of recording paper.

In the above embodiment, the image processing device instructs a predetermined print device to successively print a plurality of test charts for measuring the density unevenness in the sub-scanning direction, and arranges the profiles of the measurement data obtained by optically reading the test charts in the printing order in view of the intervals of the sheets of recording paper. Then, the image processing device analyzes the arranged measurement data and detects the long period density unevenness in the sub-scanning direction, which extends through a plurality of sheets of recording paper, to prepare the correction data for removing the detected long period density unevenness.

In the above embodiment, the image processing device firstly detects the long period density unevenness in the sub-scanning direction as described above. Next, the image processing device prepares the data in which the detected long period density unevenness in the sub-scanning direction is removed from the profiles and analyzes the data to detect the short period density unevenness in the sub-scanning direction. It is hard to influence the detection of the long period density unevenness in the sub-scanning direction by the short period density unevenness in the sub-scanning direction. On the other hand, it is easy to influence the detection of the short period density unevenness in the sub-scanning direction by the long period density unevenness in the sub-scanning direction. Therefore, by analyzing and removing the density unevenness in order of the long period density unevenness and the short period density unevenness, it is possible to more precisely detect the short period density unevenness in the sub-scanning direction.

In the above embodiment, firstly, the in-page density distribution which is always caused on the same position in the sub-scanning direction in one sheet of recording paper, is detected and removed from the profiles. Then, the long period density unevenness and the short period density unevenness in the sub-scanning direction are detected and removed.

In the above embodiment, from the number of sheets of the test charts which are printed out in unit time (for example, 30 sheets/min), the convey speed of the recording paper and the length of the recording paper in the sub-scanning direction, the interval of the sheets is calculated.

In the above embodiment, the marks are printed on a plurality of sheets of recording paper, on which the test charts are successively printed, at regular intervals including the intervals of the sheets of recording paper, and the distance of the interval of the sheets is calculated from the positions of the marks. For example, from the distance L1 from the mark A which is put on the first sheet of the recording paper near the rear end of the first sheet, to the rear end of the first sheet, the distance L2 from the mark B which is put on the second sheet of the recording paper near the front end of the second sheet, to the front end of the second sheet and the distance L3 from the mark A to the mark B, the interval (L3−L1−L2) of the sheets is calculated.

In the above embodiment, for example, the sampling pattern of the test image is changed according to whether the case in which the long period density unevenness in the sub-scanning direction is detected or the case in which the short period density unevenness in the sub-scanning direction is detected.

In the above embodiment, the test image is printed on an outside area of the effective image area, which is trimmed off and discarded.

In the above embodiment, for example, the part or the mechanism in which the period of the rotation or the motion is approximately coincident with the period of the density unevenness in the sub-scanning direction, is specified as the factor of the above density unevenness in the sub-scanning direction.

In the above embodiment, the print system comprises the image processing device for preparing the correction data for the long period density unevenness in the sub-scanning direction, and the print device to be corrected. In the print system, the print device corrects the density unevenness in the sub-scanning direction therein by using the correction data prepared by the image processing device.

In the above embodiment, the correcting unit of the print device detects the phase of the part which is the factor of the density unevenness having a certain period in the sub-scanning direction, and applies the correction data for removing the above density unevenness, so as to synchronize the correction data with the detected phase. Thereby, the above density unevenness is corrected.

According to the image processing device, the image processing method and the print system, it is possible to correct the long period density unevenness in the sub-scanning direction, which extends through a plurality of sheets of recording paper.

The present U.S. patent application claims the priority of Japanese Patent Application No. 2012-141007, filed on Jun. 22, 2012, according to the Paris Convention, and the entirety of which is incorporated herein by reference for correction of incorrect translation.

What is claimed is:

1. An image processing device comprising:

a sample output unit to instruct a predetermined print device for printing an image on conveyed recording paper, to successively print test images for detecting a density unevenness in a sub-scanning direction which is a conveying direction of the recording paper, on a plurality of sheets of the recording paper;

a profile preparing unit to prepare a plurality of profiles of the density unevenness in the sub-scanning direction in the plurality of sheets of the recording paper, from measuring data obtained by optically reading the test images which are successively printed on the plurality of sheets of the recording paper;

an analyzing unit to analyze the plurality of profiles in the plurality of sheets of the recording paper, which are prepared by the profile preparing unit, by arranging the profiles in a printing order apart from each other so as to correspond to intervals of the sheets of the recording paper, and to detect a long period density unevenness in the sub-scanning direction, which has a long period extending through the plurality of sheets of the recording paper; and a correction data preparing unit to prepare correction data for removing the long period density unevenness in the sub-scanning direction, which is detected by the analyzing unit, wherein the analyzing unit prepares data in which the long period density unevenness in the sub-scanning direction is removed from the profiles prepared by the profile preparing unit, and detects a short period density unevenness in the sub-scanning direction, which has a short period contained in one sheet of the recording paper, by analyzing the prepared data, and the correction data preparing unit prepares correction data for removing the detected short period density unevenness in the sub-scanning direction.

2. The image processing device of claim 1, wherein the analyzing unit calculates an in-page density distribution which is always caused on a same position in the sub-scanning direction in one sheet of the recording paper, from the plurality of profiles in the plurality of sheets of the recording paper, which are prepared by the profile preparing unit, and detects the long period density unevenness in the sub-scanning density after the in-page density distribution is removed.

3. The image processing device of claim 1, wherein the analyzing unit calculates the intervals of the sheets from the number of sheets on which the test image is printed by the print device in unit time, a convey speed of the recording paper and a length of the recording paper in the sub-scanning direction.

4. The image processing device of claim 1, wherein the sample output unit instructs the print device to print predetermined marks on the plurality of sheets of the recording paper on which the test images are printed, so as to arrange the marks in the sub-scanning direction at regular intervals including the intervals of the sheets, and the analyzing unit calculates the intervals of the sheets in accordance with positions of the marks printed on the plurality of sheets of the recording paper.

5. The image processing device of claim 1, wherein a sampling pattern of the measuring data for preparing the profiles of the density unevenness in the sub-scanning direction is changed according to a type of the density unevenness in the sub-scanning direction to be detected.

6. The image processing device of claim 1, wherein the sample output unit instructs the print device to print the test images on the recording paper out of an effective image area.

7. The image processing device of claim 1, further comprising a factor specifying unit to specify a factor of the density unevenness in the sub-scanning direction in accordance with a period of the detected density unevenness in the sub-scanning direction.

8. A print system, comprising:

a print device to print an image on conveyed recording paper; and an image processing device to instruct the print device to print a test image for detecting a density unevenness in a sub-scanning direction which is a conveying direction of the recording paper, and to prepare correction data for correcting the density unevenness in the sub-scanning direction, wherein the print device comprises a correcting unit to correct the density unevenness in the sub-scanning direction in accordance with the correction data prepared by the image processing device, and wherein the image processing device comprises:

a sample output unit to instruct the print device to successively print the test images on a plurality of sheets of the recording paper;

a profile preparing unit to prepare a plurality of profiles of the density unevenness in the sub-scanning direction in the plurality of sheets of the recording paper, from measuring data obtained by optically reading the test images which are successively printed on the plurality of sheets of the recording paper;

an analyzing unit to analyze the plurality of profiles in the plurality of sheets of the recording paper, which are prepared by the profile preparing unit, by arranging the profiles in a printing order apart from each other so as to correspond to intervals of the sheets of the recording paper, and to detect a long period density unevenness in the sub-scanning direction, which has a long period extending through the plurality of sheets of the recording paper; and a correction data preparing unit to prepare the correction data for removing the long period density unevenness in the sub-scanning direction, which is detected by the analyzing unit, wherein the analyzing unit prepares data in which the long period density unevenness in the sub-scanning direction is removed from the profiles prepared by the profile preparing unit, and detects a short period density unevenness in the sub-scanning direction, which has a short period contained in one sheet of the recording paper, by analyzing the prepared data, and the correction data preparing unit prepares correction data for removing the detected short period density unevenness in the sub-scanning direction.

9. The print system of claim 8, wherein the correcting unit corrects the density unevenness in the sub-scanning direction having a predetermined period by synchronizing the correction data with a phase of a periodic motion of a part which is a factor of the density unevenness in the sub-scanning direction.

10. An image processing method, comprising:

instructing a predetermined print device for printing an image on conveyed recording paper, to successively print test images for detecting a density unevenness in a sub-scanning direction which is a conveying direction of the recording paper, on a plurality of sheets of the recording paper;

preparing a plurality of profiles of the density unevenness in the sub-scanning direction in the plurality of sheets of the recording paper, from measuring data obtained by optically reading the test images which are successively printed on the plurality of sheets of the recording paper;

analyzing the plurality of prepared profiles in the plurality of sheets of the recording paper, by arranging the profiles in a printing order apart from each other so as to correspond to intervals of the sheets of the recording paper, and detecting a long period density unevenness in the sub-scanning direction, which has a long period extending through the plurality of sheets of the recording paper;

preparing correction data for removing the detected long period density unevenness in the sub-scanning direction;

correcting the density unevenness in the sub-scanning direction in accordance with the correction data in a printing carried out by the print device; and preparing data in which the detected long period density unevenness in the sub-scanning direction removed from the profiles, and detecting a short period density unevenness in the sub-scanning direction, which has a short period contained in one sheet of the recording paper, by analyzing the prepared data, and preparing correction data for removing the detected short period density unevenness in the sub-scanning direction.

11. The image processing method of claim 10, further comprising:

calculating an in-page density distribution which is always caused on a same position in the sub-scanning direction in one sheet of the recording paper, from the plurality of profiles in the plurality of sheets of the recording paper, and removing the in-page density distribution from the profiles, wherein the long period density unevenness in the sub-scanning direction is detected by using the profiles which are obtained after the in-page density distribution is removed.

12. The image processing method of claim 10, further comprising:

calculating the intervals of the sheets from the number of sheets on which the test image is printed by the print device in unit time, a convey speed of the recording paper and a length of the recording paper in the sub-scanning direction.

13. The image processing method of claim 10, further comprising:

instructing the print device to print predetermined marks on the plurality of sheets of the recording paper on which the test images are printed, so as to arrange the marks in the sub-scanning direction at regular intervals including the intervals of the sheets, and calculating the intervals of the sheets in accordance with positions of the marks printed on the plurality of sheets of the recording paper.

14. The image processing method of claim 10, wherein a sampling pattern of the measuring data for preparing the profiles of the density unevenness in the sub-scanning direction is changed according to a type of the density unevenness in the sub-scanning direction to be detected.

15. The image processing method of claim 10, wherein the print device is instructed to print the test images on the recording paper out of an effective image area.

16. The image processing method of claim 10, further comprising:

specifying a factor of the density unevenness in the sub-scanning direction in accordance with a period of the detected density unevenness in the sub-scanning direction.

* * * * *